United States Patent [19]

Trevor, Jr.

[11] Patent Number: 4,930,399

[45] Date of Patent: Jun. 5, 1990

[54] HIGH VOLUME AUTOMATIC AND SEMI-AUTOMATIC FIREARM

[76] Inventor: John Trevor, Jr., 11432 SW. 113 Pl., Miami, Fla. 33176

[21] Appl. No.: 294,410

[22] Filed: Jan. 9, 1989

[51] Int. Cl.[5] ..... F41D 5/04; F41D 11/02; F41D 11/04

[52] U.S. Cl. ..... 89/191.02; 89/185; 89/191.01

[58] Field of Search ..... 89/191.02, 191.01, 185

[56] References Cited

U.S. PATENT DOCUMENTS

| | | | |
|---|---|---|---|
| 2,231,978 | 2/1941 | Wesson | 42/18 |
| 3,566,745 | 3/1971 | Jauch et al. | 89/187.01 |
| 3,738,219 | 6/1973 | Febres | 89/1.703 |
| 3,776,095 | 12/1973 | Atchisson | 89/128 |
| 3,782,021 | 1/1974 | Atchisson | 42/1.05 |
| 3,850,076 | 11/1974 | Atchisson | 89/196 |
| 3,901,125 | 8/1975 | Raville | 89/163 |
| 3,942,277 | 3/1976 | Atchisson | 42/25 |
| 3,942,410 | 3/1976 | Atchisson | 89/139 |
| 3,964,173 | 6/1976 | Atchisson | 33/254 |
| 3,964,366 | 6/1976 | Atchisson | 89/148 |
| 3,999,461 | 12/1976 | Johnson et al. | 89/191.01 |
| 4,057,003 | 11/1977 | Atchisson | 89/138 |
| 4,128,042 | 12/1978 | Atchisson | 89/138 |
| 4,169,329 | 10/1979 | Atchisson | 42/16 |
| 4,201,113 | 5/1980 | Seecamp | 89/199 |
| 4,297,800 | 11/1981 | Atchisson | 42/49.01 |
| 4,358,986 | 11/1982 | Giorgio | 89/142 |
| 4,426,802 | 1/1984 | Walker | 42/59 |
| 4,502,367 | 3/1985 | Sullivan | 89/199 |
| 4,553,469 | 11/1985 | Atchisson | 89/191.02 |
| 4,569,270 | 2/1986 | Timari | 89/199 |
| 4,654,993 | 4/1987 | Atchisson | 42/71.01 |
| 4,655,118 | 4/1987 | Bruderer et al. | 89/185 |
| 4,693,170 | 9/1987 | Atchisson | 89/149 |
| 4,704,945 | 11/1987 | Marcon et al. | 89/185 |

*Primary Examiner*—David H. Brown

*Attorney, Agent, or Firm*—Fisher, Christen & Sabol

[57] ABSTRACT

This invention relates to a shotgun which has low felt recoil, a reliable loading of blunt nosed shells and which can fire a high number of rounds per minute. More particularly, this invention relates to an automatic or semi-automatic shotgun which has a low felt recoil but yet reliably can be fired at a high rate using a variety of blunt nosed shells.

17 Claims, 8 Drawing Sheets

HIGH VOLUME AUTOMATIC AND SEMI-AUTOMATIC FIREARM

BACKGROUND OF THE INVENTION

In the general area of firearms there has been much development for military and police purposes of automatic and semi-automatic firearms. Generally these firearms have been developed to fire relatively small caliber shells. Such firearms do not have the recoil of a shotgun and further do not present the same problems with regard to the loading of shells into the firing chamber and the subsequent ejection of the spent shells from the firing chamber. Shotgun shells are several times larger than the shells that are conventionally used in automatic and semi-automatic weapons and generally are not of the same uniformity from shell to shell. However, a shotgun will provide the person handling the weapon with a greater degree of protection. By this it is meant that a shotgun will put out a pattern of projectiles over a certain area rather than firing one projectile into that area. This increases the probability that a target will be hit with at least some of the projectiles, even from a rather long distance.

The present shotgun firearm can be accurately used at a distance of at least 100 yards. At this distance the operator of the shotgun will be able to disable his target. This is from but a single shell. However, when used in the automatic mode, this firearm will fire shells at a rate that a fairly large area can be covered. For instance, this firearm is capable of firing at least 360 rounds per minute. In the semi-automatic mode the number of rounds per minute will be controlled by the person using the firearm.

Another significant feature of the present firearm is its simplicity. The firearm consists of very few parts, but yet is highly reliable and is not subject to shell misfirings. That is, there is a positive injection of each shell into the firing chamber and a reliable ejection of the spent shells from the firing chamber. In the past it has been difficult to feed shotgun shells from the magazine into the firing chamber under high rates of firing due to the recoil of the firearm and other problems. The positive injection of shells is primarily the result of the angle of the magazine with relation to the firing chamber and the particular bolt carrier and bolt arrangement that is used in this firearm.

The magazines that can be used are either the straight or curved clip, or the round drum magazine. The round drum magazine is capable of holding more rounds of ammunition and would be preferred in combat situations. The bolt carrier and bolt arrangement is also a unique feature of this firearm. The bolt carrier and bolt arrangement permit for a timing between the bolt carrier and bolt, and further the arrangement will absorb the torquing moment of the weapon while it is being fired.

This present firearm is gas actuated. That is, after the loading of the first shell manually, the other shells are automatically loaded into the firing chamber. In such a firearm some of the gases that have been produced during the firing of the weapon will provide the necessary energy for the remainder of the firing of the weapon. That is, these gases will move the bolt carrier and bolt rearwardly after each round is fired. In this regard some of the high pressure gases from the barrel are utilized in the operation of the bolt carrier and of the bolt. The timing of the movement of the bolt with relation to the bolt carrier also is an important feature with regard to the present firearm. Without this proper timing the weapon would be subject to misfiring, and particularly when it was being used in the full automatic mode.

SUMMARY OF THE INVENTION

The present firearm overcomes many of the problems of the prior art while yet being relatively simple in design and in operation. This firearm can rapidly shoot shotgun shells at rates of 360 rounds per minute and more. A problem with regard to such a weapon is the tendency of the weapon to misfire. A misfiring can result from various operations of the firearm. However, the most common reasons for a misfire of a firearm of this type results from the improper ejection of a spent shell from the firing chamber and/or the improper insertion of a shell into the firing chamber. This is particularly the case when the weapon is being fired at a rate of 360 rounds per minute or more which is equivalent to 6 rounds per second or more.

These problems have been resolved in part by providing an angle of about 4 to 6 degrees, and preferably about 5 degrees for the magazine with relation to the breech of the firing chamber. This angle of the magazine compensates for the slight recoil of the weapon when it is being fired. In addition, there is the use of a unique arrangement between the bolt carrier and the bolt of the firearm. The bolt carrier is in essence a piston which is actuated by the gases from a fired shell. On the front of the bolt carrier is the piston head which is pressurized upon the firing of each round. At the rear of the piston there is a downwardly extending section which is attached to the bolt. This downwardly extending section has two apertures and a forwardly extending cam. One of these apertures is elongated in shape and receives a travel limiting pin while the other aperture is elongated and at a forward end has a downwardly extending portion. In this second aperture a roller is inserted. The forwardly extending cam fits into a locking pin on the bolt which serves to lock the bolt and bolt carrier. A key feature here is the roller that is in the second aperture. This roller rides on the roller track in the receiver. The bolt contains at the forward point of travel of the roller a slight indentation into which the roller will fall in conjunction with falling into the downwardly extending portion in the second aperture. It is this roller and the operation of this roller in the bolt, bolt carrier and roller track which provides for the correct timing between the bolt and bolt carrier. This roller assembly also absorbs the torque moment on the bolt upon the weapon being fired. Another feature of this weapon is with regard to the face of the bolt. On the periphery of the bolt face which contacts the shell there is on one side an extractor pin and on the other side a sub-extractor pin. However, there is also at a point above these pins a stabilizing pin for stabilizing the shell against the bolt face.

A further advance in the bolt carrier and the bolt assembly consists of the auto kicker that is a part of the bolt carrier. The auto kicker is located on the bottom portion of the bolt carrier and is a spring loaded clip which when the bolt is in forward position can move freely upwardly and downwardly through the action of the spring, but when the bolt moves rearwardly on the bolt carrier, this auto kicker rides up onto a cam on the bolt and the kicker is then in a set downwardly extending position.

This bolt and bolt carrier is a relatively non-complex apparatus. There are few pieces and few moving parts which increase the reliability of the firearm. Further, there is very little wear of the moving parts such as of the bolt and bolt carrier during the operation of the firearm.

The firearm can be operated in either the automatic or semi-automatic mode. In the operation of the firearm the first shell is manually fed into the firing chamber. The weapon is adjusted for automatic or semi-automatic operation by means of a lever on the side of the trigger portion of the firearm. When the firearm is to be operated in the semi-automatic mode, the auto sear is maintained out of the firing sequence by means of the auto kicker. The operation in this mode is solely by the disconnector and by the trigger sear in the trigger section. In the automatic mode, the disconnector and the trigger sear are removed from the sequence by means of the selection lever. This then just leaves the auto sear and auto kicker in the sequence. As long as the trigger is depressed, the auto sear and auto kicker will permit the bolt carrier and bolt to continuously cycle.

DETAILED DESCRIPTION OF THE INVENTION

Figure 1:
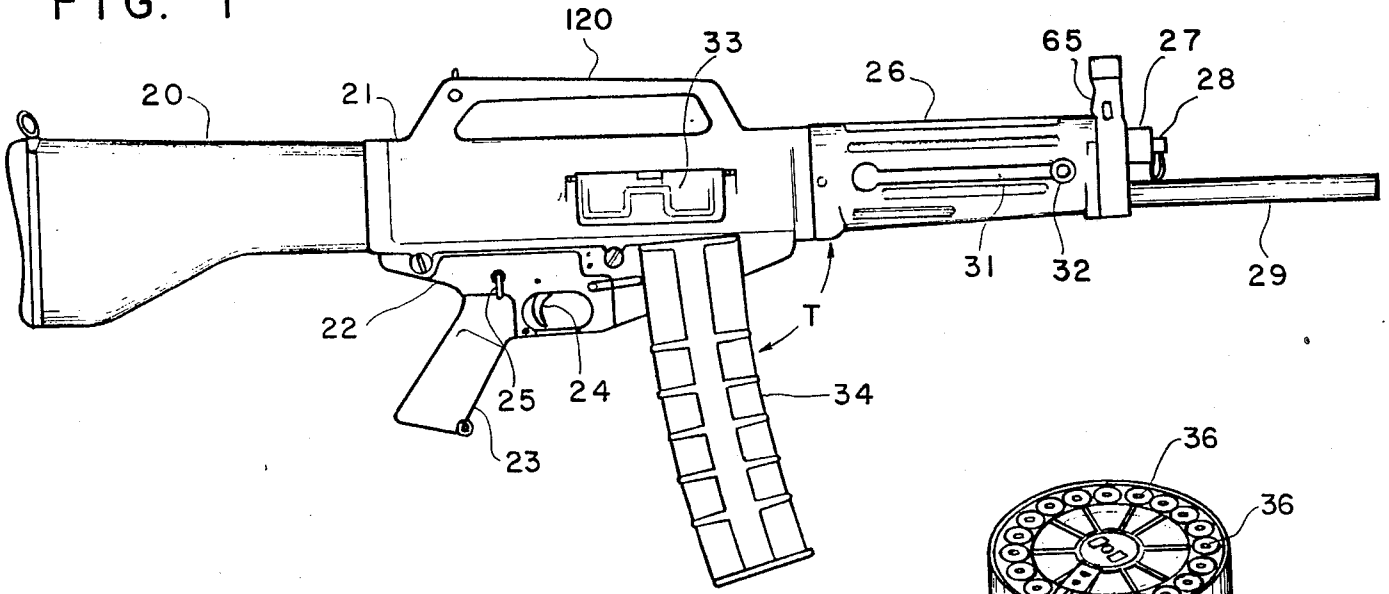
FIG. 1 is an elevational view of the firearm in its fully assembled condition.
Figure 1A:
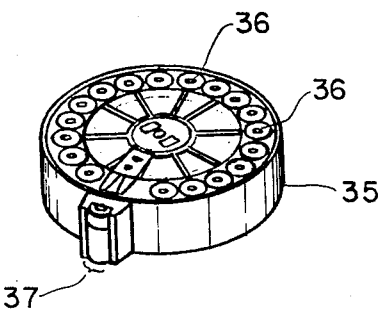
FIG. 1A is a perspective view of a drum magazine for use with the firearm.

The present firearm will now be described with specific reference to the drawings. FIG. 1 shows the firearm in its fully assembled condition. The firearm consists of butt stock 20 which interfits into receiver 21. Receiver 21 has a sight support 120 and a door 33 for the ejection of spent shells. In a lower portion of receiver 21 is magazine 34, which is shown here as an arched clip, which holds a plurality of shells. This magazine can also be linear or be a drum as shown in FIG. 1*a*. Beneath the receiver section 21 is the trigger section 22. The magazine will be offset forwardly at an angle of about 4° to 6°, and preferably about 5° axis. In other words, the centerline of the magazine which is the axis which extends upwardly through the firearm will be at an angle T of about 84° to 86°, and preferably about 85°, from the axis of the firing chamber and forwardly extending barrel portion. This provides the magazine with a forward biased orientation as shown in FIG. 1. The angle of the magazine in a rearward direction will be about 94° to 96° and preferably about 95°. Below the receiver section is the trigger section 22. This trigger section comprises the handle 23, the trigger 24 and the selector lever 25. The selector lever selects the mode of operation for the firearm. That is, the selector lever is utilized to either select the semi-automatic or the automatic mode for the firearm. In front of the receiver section 21 is the hand grip section 26. This section consists of an area where the weapon can be gripped while being fired. In addition this section carries slot 31 and lever 32. Lever 32 is moved rearwardly to move the bolt and bolt carrier rearwardly and to permit the first shell from the magazine to enter the firing chamber. At the front of the firearm there is shown part of the barrel 29 and the guide rod 28. The guide rod 28 is fastened into position by means of the cap assembly 27. A gas tower 65 inter-connects the barrel and the guide rod. At the top of the gas tower is front sight piece 60.

When the firearm is being operated, it is gripped by means of handle 23 and the hand gripping region 26. At the same time, the rear of the butt portion 20 is abutting the person's shoulder. In this manner the person has a three-point grip onto the weapon. That is, the weapon is being gripped by means of both hands and by being pressed against the person's shoulder.

FIG. 1A shows a drum magazine 35 which can be utilized in place of the arcuate magazine 34. The drum magazine will carry more rounds than the arcuate magazine. It would thus be preferred in combat situations. The drum magazine is shown containing a plurality of shells 36. The shells exit the magazine at opening 37. The drum magazine will be at the same angle to the plane of the barrel and firing chamber as the arcuate magazine.

Figure 2:
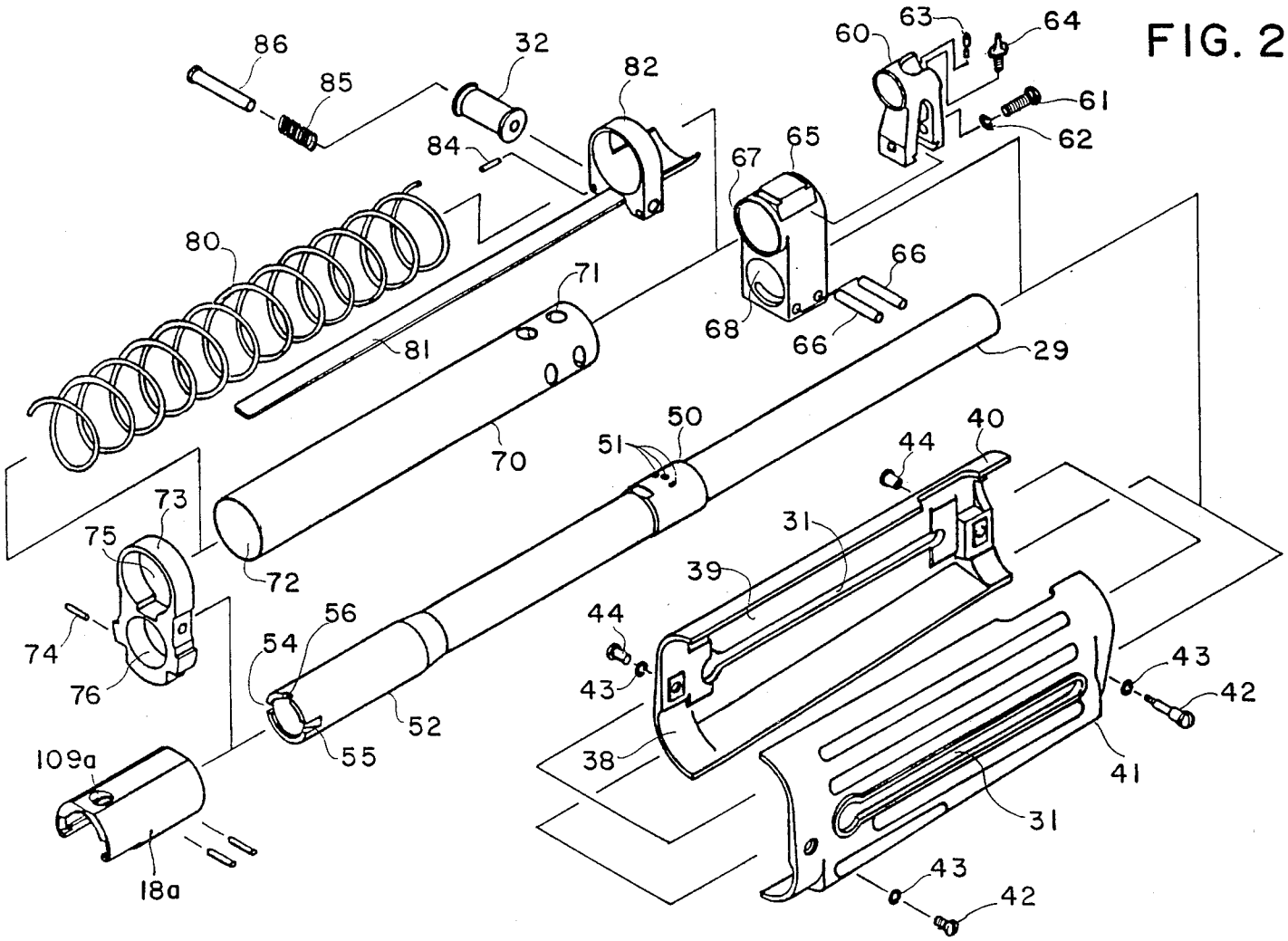
FIG. 2 is an exploded view of the barrel and hand grips assembly of the firearm.

FIG. 2 shows the barrel and hand grips section of the gun in its component pieces. In this view there is shown left hand grip 40 and right hand grip 41. These hand grips are held together by means of screws 42, washers 43 and nut fasteners 44. Maintained within the hand grips are both the barrel 29 and the cylinder tube 70. The barrel is located in the lower part 38 of the hand grip while the cylinder tube 70 is in the upper part 39 of the hand grip section. In this view gas interconnector tower 65 accepts the barrel 29 into opening 68. The barrel 29 passes through opening 68 until the region 50 of the barrel is within the gas communication tower 65. In this way gases can exit from the barrel by means of openings 51 and traverse upwardly in gas tower 65. Cylinder tube 70 is maintained adjacent to opening 67 of the gas tower. The bolt carrier 90 extends through cylinder tube 70 with front end portion 91 of the bolt carrier extending into the gas tower. The openings 71 serve as gas exhaust ports. Pins 66 maintain the gas tower in position on the barrel. In this way the gas tower 65 is rigidly attached to the barrel 29. Attached to the top of the gas tower is the sighting means 60. This is connected onto the upper part of the gas tower by means of screw 61 and washer 62. Sighting pin 64 screws downwardly into the sighting means 60 and is maintained in position by means of screw and spring assembly 63.

Figure 3:
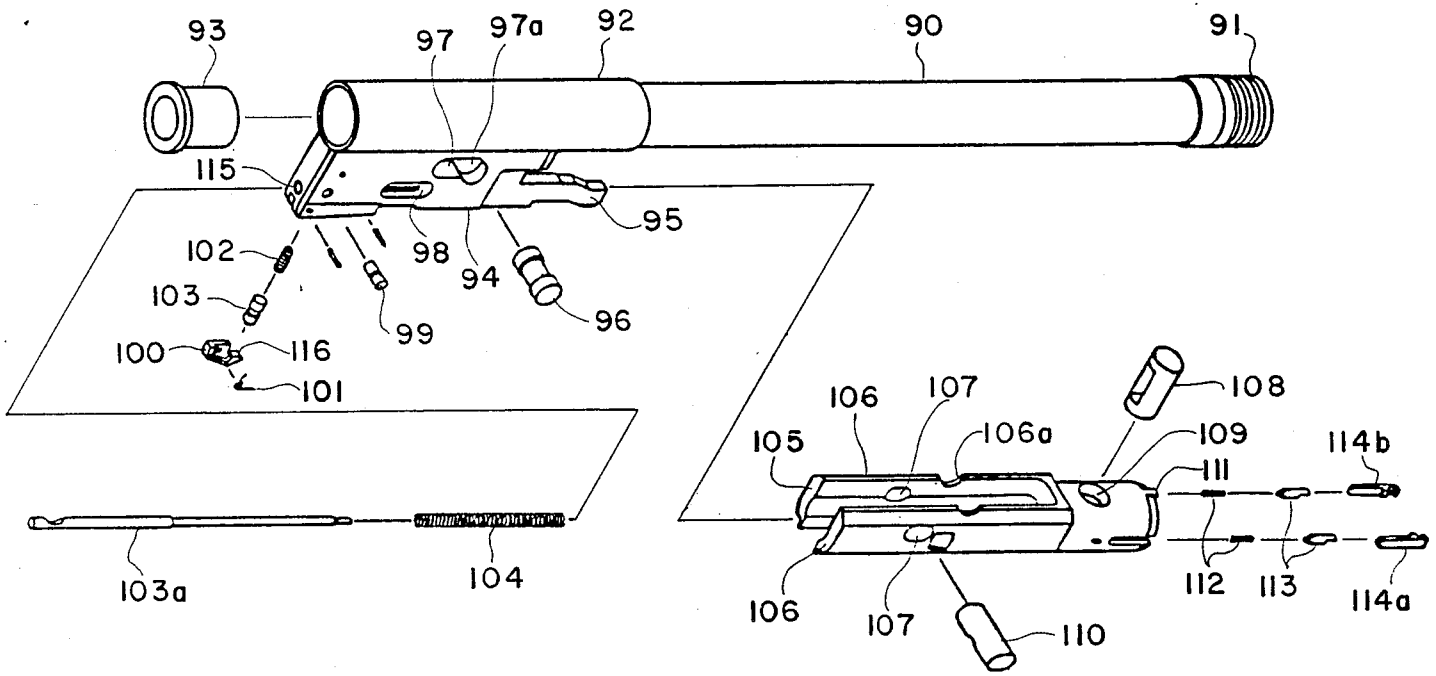
FIG. 3 is an exploded view of the bolt carrier and bolt assembly of the firearm.

At the rear of the barrel 29 is the thickened region 52 which comprises the firing chamber. This region 52 fits into opening 76 of the barrel support 73. The tube 70 is held in position by means of opening 75. At the rear of the barrel, barrel extension 18 is shown. This is fixedly attached to the barrel by pins 18*a*. Barrel extension 18 has an opening 109*a* on the top thereof which is adapted to receive a locking pin for the bolt (FIG. 3). Disposed on top of opening 109*a* is rod 81. This rod acts as a mechanism with regard to the front surface of portion 92 of the bolt carrier to move the bolt rearwardly so that a shell can be admitted to the breech of the weapon. Support 82 is disposed around the end of the tubing 70 with the rod 81 located below the tubing 70. Also disposed around tubing 70 is the spring 80 which is utilized for tensioning the manual charging of the first shell into the firearm. This mechanism consists of support 82, lever 32, spring 85 and fastening means 86 which maintains the lever 32 attached to section 82. With this support 82 in combination with the spring 80 and rod 81 disposed around the tubing 70, the hand loading mechanism is maintained rigidly in position. Tube 70 also aligns the barrel and barrel extension in correct alignment with respect to the receiver section and the trigger section. This mechanism including support 82 lies adjacent to the gas tower 65 in the area of opening 67. Upon the actuation of lever 32 the support 82 and rod 81 move rearwardly against spring 80 and contacts the front surface of portion 92 of the bolt carrier (FIG. 3) which forms a portion of increased diameter. This then moves the bolt and bolt carrier mechanism rearwardly so that a shell can enter the firing chamber from the magazine which is disposed below the firing chamber.

FIG. 3 shows the bolt carrier and bolt mechanism in an exploded view. The bolt carrier 90 will extend through the tubing 70 and be aligned within tubing 70. The front end 91 of the bolt carrier is disposed within the gas tower 65 so that the gas from the barrel will impinge against the front end or piston 91 of the bolt carrier designated 90. At the rear of the bolt carrier 90 is section 92 which has disposed therebelow section 94 which is interconnected with the bolt 105. Guide bushing 93 is for the guide rod 28 which extends through the bolt carrier 90. In the portion 94 which is disposed below the tubular portion of the bolt carrier there are shown two apertures and a cam. Aperture 97 is adapted to receive roller 96. Aperture 98 is adapted to receive pin 110 which is a pin which limits the travel of the bolt 105 on the bolt carrier portion 94. The cam 95 extends forwardly into the bolt and more particularly into locking pin 108 of the bolt. Locking pin 108 fits downwardly into opening 109. The bolt 105 has openings 107 to accept the pin 110. The bolt has an upper surface 106. In a locking position when the roller is down in the indent 97*a*, the roller will also be in indent 106*a*. The bolt and bolt carrier are then locked together by the roller. On the front of the bolt there is extractor 114*a* and sub-extractor 114*b*. The extractor plungers 113 sit behind the extractor and sub-extractor with springs 112 utilized for tensioning the extractor and subextractor. Also shown in this view is the firing pin 103 and firing pin spring 104. The firing pin fits into opening 115, traverses section 94, and enters into bolt 105 at a point below the locking pin 108. The firing pin will exit the bolt 105 at the center of the face of the bolt which is adjacent the shell in the firing chamber. Disposed on a lower portion of the bolt carrier is the auto sear kicker 100. This is maintained in the bolt carrier by means of bushing 102 and guide rod 103*a*. Spring 101 tensions the auto sear kicker. Surface 116 of the auto sear kicker is adapted to contact a cam surface on the lower portion of the bolt 105 and thus go into a locked position at certain times during the movement of the bolt with regard to the bolt carrier and the operation of the firearm.

Figure 4:
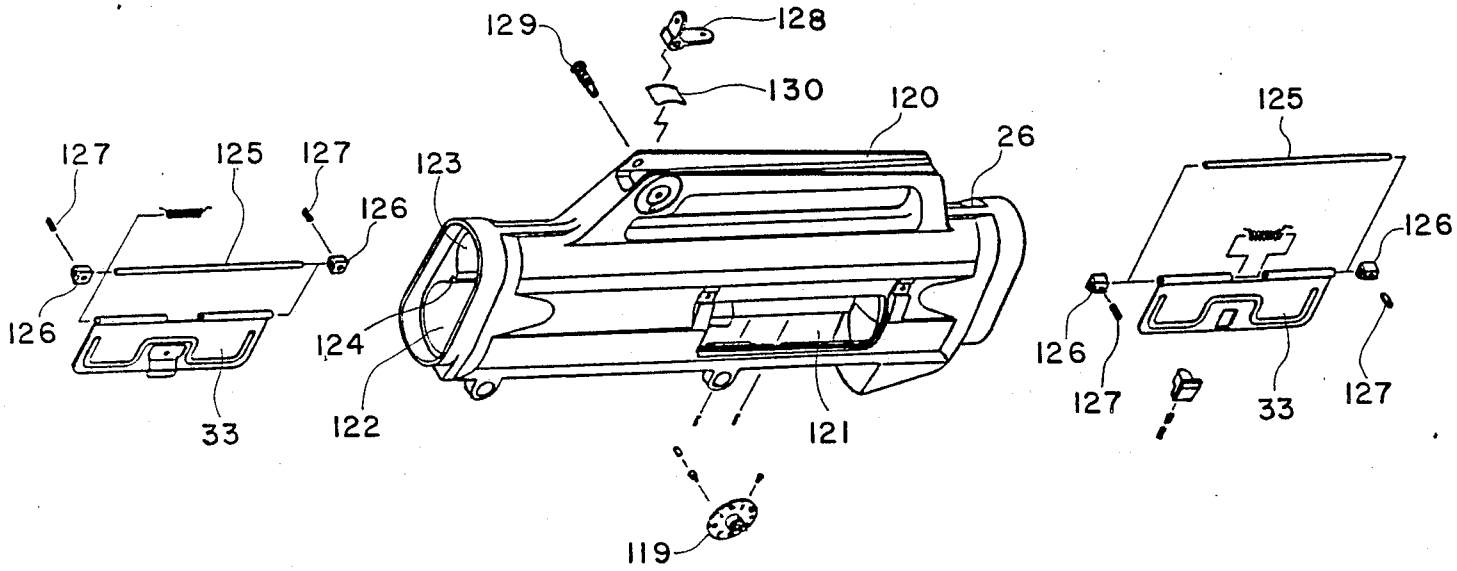
FIG. 4 is a partial exploded view of the receiver section of the firearm.

In FIG. 4 there is shown a receiver portion 26*a* of the firearm. The receiver portion 26*a* is adapted to receive the barrel 29 in opening 122 and the bolt carrier 90 in opening 123. On the upper part of opening 122 is track 124 which is contacted by the roller 96 during the movement of the bolt with respect to the bolt carrier. The roller does not contact surface 106. On the upper part of the receiver is a portion 120 which is utilized to carry the rear sight. In this view the rear sight is shown as sight 128 which is spring biased by means of spring 130. This sight is maintained on a rear part portion 120 by means of screw 129. Rather than this type of sight 128, a more elaborate sight such as a telescopic sight, can be utilized and fastened to this sight retaining portion 120. There is also shown in this view the doors 33 which are utilized to cover the shell loading and ejection area when the firearm is not in usage. This is also known as the breech. These ejection doors are maintained in position by means of housings 126 which accept pin 125. The housings are fastened to the receiver by means of pins 127. These doors are maintained in a closed position until it is desired to use the firearm, then depending on the side of the firearm that the shell is to be ejected, that door will be opened. Also shown in this view is drum windage 119. This drum windage is utilized to adjust the sights laterally for windage.

Figure 5:
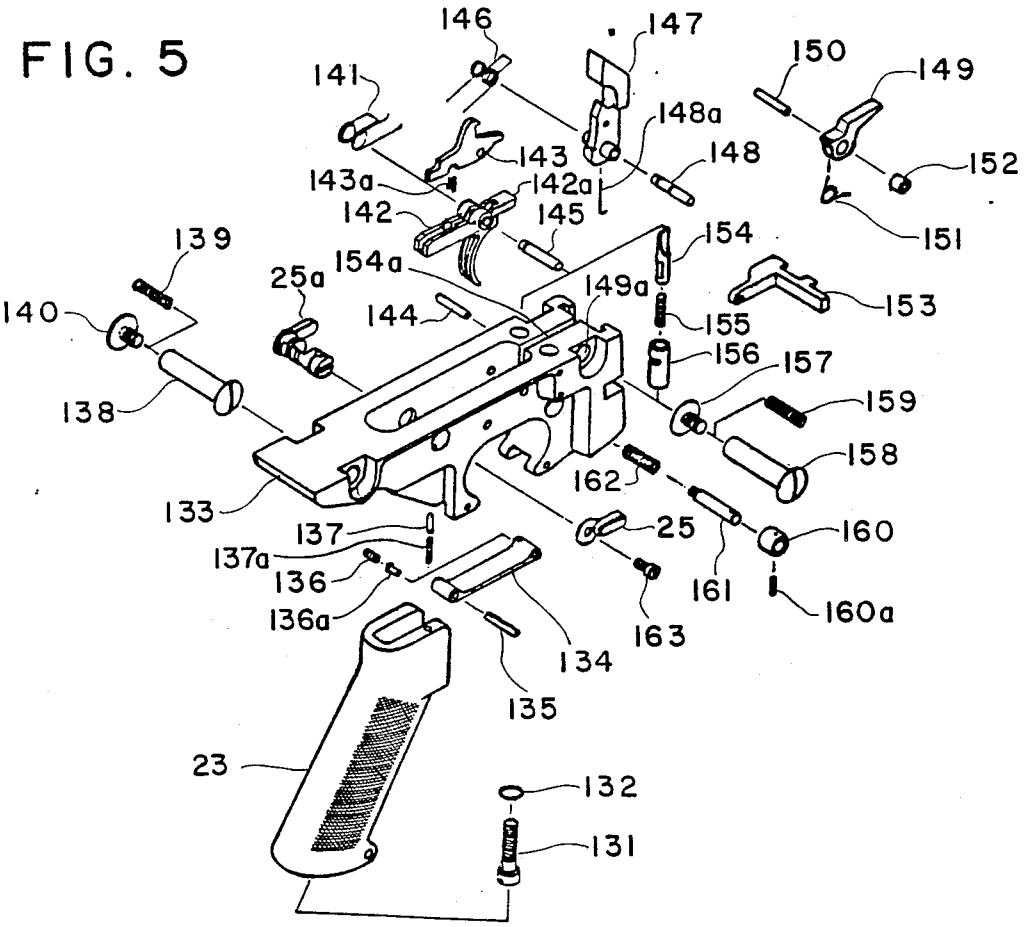
FIG. 5 is an exploded view of the trigger housing section of the firearm.
Figure 10:
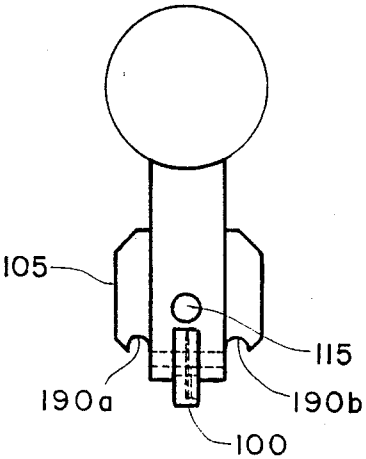
FIG. 10 is an elevational view of the rear part of the bolt.

FIG. 5 shows the trigger housing section of the firearm. This section of the firearm consists of handle 23 which has disposed thereabove trigger housing 133. Attached to a lower portion of trigger housing 133 is trigger guard 134. This is attached to the housing by means of pin 135 and trigger guard plunger 136*a* and spring 136. The trigger housing section 133 is attached to the receiver portion at one end by means of screw 138, retaining spring 139 and retaining nut 140 and at the other end by means of screw 158, spring 159 and retaining nut 157. Fire control selector detent 137 is tensioned by spring 137*a*. Also shown in this view is selector 25 and sub-selector 25*a*. Either the selector or sub-selector can be utilized to select whether the weapon is to be used in the automatic or in the semiautomatic mode. One is on one side of the firearm and the other on the other side. This selector and sub-selector are maintained in position by means of screw 163. The trigger 142 is maintained within the trigger housing by means of pin 145. The trigger is tensioned by means of spring 141. The disconnector 143 is connected to the trigger 142 and tensioned by means of spring 143*a*. The trigger sear 142*a* actuates the hammer 147 when the weapon is fired. The trigger is maintained in the trigger housing by means of hammer pin 148. Spring 146 is a tensioning spring. The hammer pin is retained by the retainer 148*a*. The ejector 154 is maintained in opening 154*a* by means of spring 155 and ejector bushing 156. The ejector rides in slot 190*a* or 190*b* of the bolt. These slots are shown in FIG. 10. The auto sear 149 is maintained in position by means of the auto sear pin 150 and bushing 152. The auto sear is held in tension by means of auto sear spring 151. The magazine catch assembly consists of catch 153 which is maintained in position by means of spring 162, pin 161 and bushing 160. Pin 160*a* is utilized to lock bushing 160. Many of the elements in the trigger housing section are common to various weapons that can be fired in an automatic or semiautomatic mode. In fact, in the present instance, various modifications could be made to the trigger housing section and yet produce an operable trigger mechanism for the present firearm.

Figure 6:
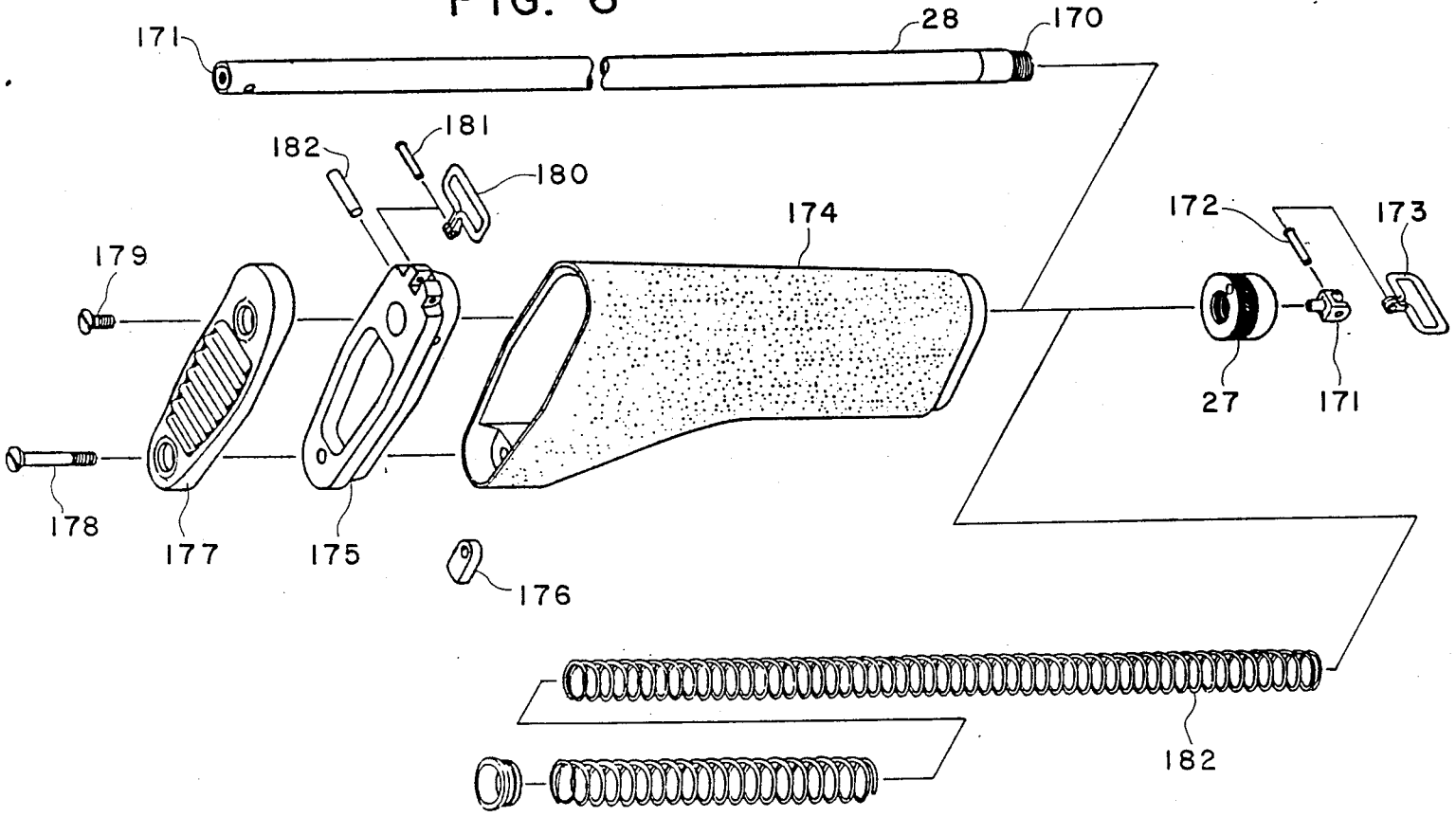
FIG. 6 is a partial exploded view of the butt stock and butt plate section of the firearm.

FIG. 6 shows the butt stock portion of the firearm. There is shown here guide rod 28 which has threaded portion 170. Internally threaded end 171 of the guide rod is fastened to a back plate 175 and a rubber butt plate 177 by means of screw 179. The lower part of the butt plate 175 and the rubber butt plate 177 is held within the stock 174 by means of screw 178. Swivel 180 is maintained on the butt plate by means of pin 181 and swivel pin 182. Disposed around guide rod 28 is the spring 182. When the gun is assembled, attached to end 170 of the guide rod is the cap assembly 27. This consists of a swivel 173 which is maintained as a part of the cap 27 by means of pin 172 and bracket 171. It is this cap assembly which upon being attached to the guide rod 28 that maintains the firearm in an assembled condition. This cap 27 is disposed in front of the gas tower through which the guide rod passes. The guide rod is not connected to the gas tower. It is only connected to the back plate and to the cap assembly. This arrangement is shown in FIG. 1.

Figure 7:
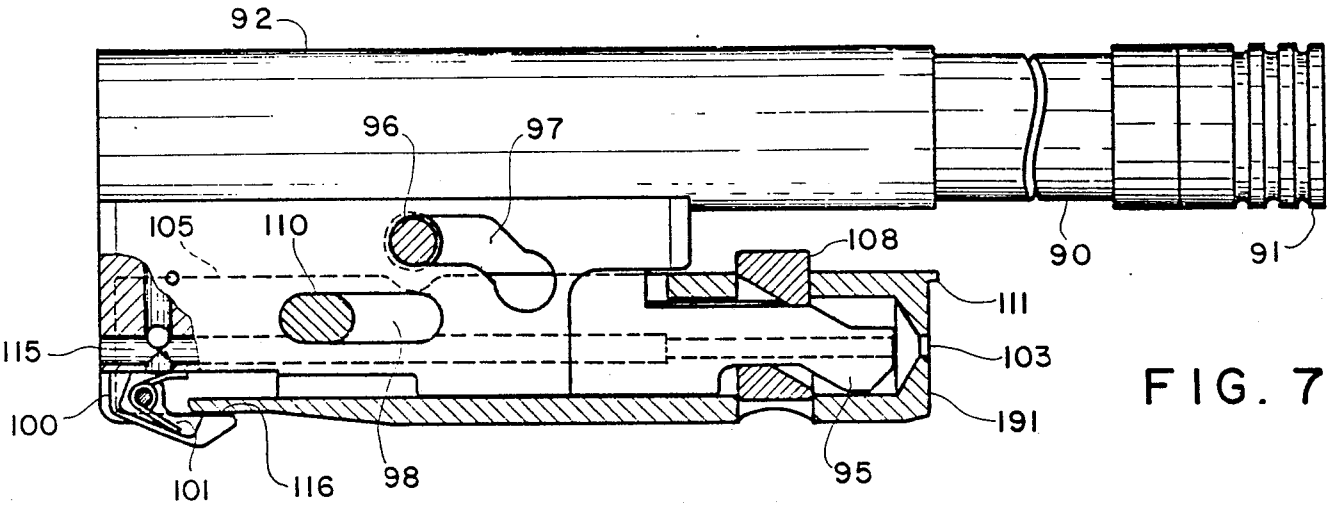
FIG. 7 is an elevational view partially in section of the bolt carrier and bolt assembly in a position for firing a cartridge.
Figure 8:
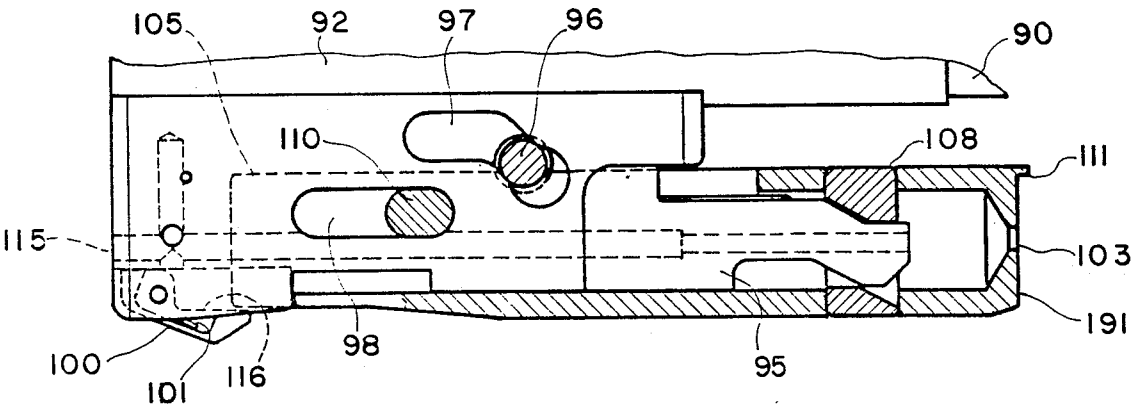
FIG. 8 is an elevational view partially in section of the bolt carrier and bolt mechanism after the firing of a cartridge.

FIG. 7 shows the arrangement of the bolt carrier and the bolt when the firearm is in a condition for firing. At this point, there will be a shell in the firing chamber. It is seen here in this arrangement that the bolt is in its most forward location which is controlled by pin 110 in slot 98. Also shown in this embodiment is the fact that roller 96 is in the rearward portion of the aperture 97 and is not in the indent 97(*a*) of the bolt carrier. It is seen here in this embodiment that cam 95 has actuated a locking pin 108 so that the bolt carrier and the bolt are in a locked state to the barrel extension. When the weapon is fired gases contact the end 91 of the gas cylinder which constitutes part of the bolt carrier and moves the bolt carrier rearwardly. These gases pass upwardly from area 50 of the barrel into the gas tower 65 (see FIG. 2). This rearward motion of the bolt carrier causes cam 95 to force downwardly the locking pin 108 so that it can move downwardly and permits the roller 96 to move to the forward indent 97*a* of the guide aperture 97. At this point also the locking pin 110 is at the frontmost location in the slot designed to limit the travel of the bolt on the bolt carrier. This latter arrangement after the firing of the weapon is shown is FIG. 8. It is this movement of the roller from its position in FIG. 7 to its position in FIG. 8 that provides for the unique timing between the bolt and bolt carrier. It is this unique timing that aids to prevent misfires of the firearm and absorbs the torque from the firing. The time required for the movement of the roller provides time for the ejection of the spent shell casing and the insertion of a new shell from the magazine. In the operation of the gun none of the gases pass down through the center of bolt carrier 90 for the reason that the guide rod 28 passes up through the cylindrical portion of the bolt carrier.

Figure 9:
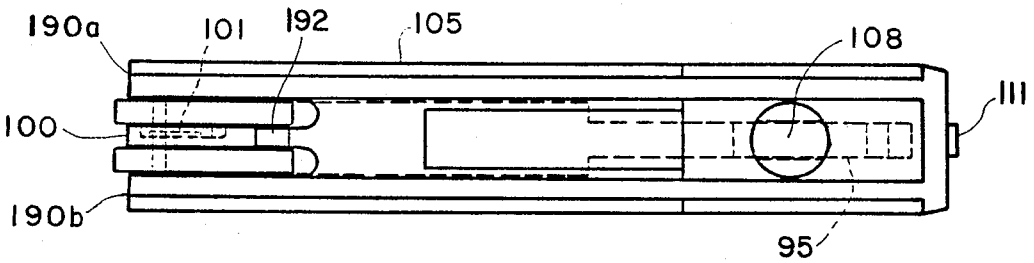
FIG. 9 is a plan view of the lower surface of the bolt and bolt carrier assembly showing the auto kicker.

In FIG. 9 there is shown the bottom surface of the combined bolt carrier and bolt. This view shows the auto kicker 100 and the cam 192 on the bolt. This cam operates in conjunction with the auto kicker which is spring loaded. When contacted by the cam 192, the auto kicker is locked in position and will trip the auto sear 149 as it traverses rearwardly. This auto sear comes into play when the firearm is utilized in the fully automatic state. The slots 190*a* and 190*b* accept the ejector 154 which is a part of the trigger section.

FIG. 10 shows the rear of the bolt and bolt carrier. The bolt 105 has slots 190*a* and 190*b* in which the ejector 154 of the trigger section rides. The auto sear kicker is 100 and the channel to receive the firing pin 115.

Figure 11:
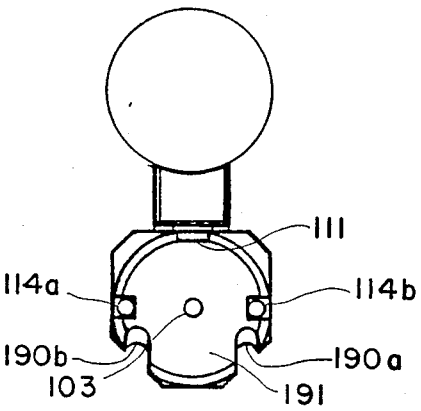
FIG. 11 is an elevational view of the face of the bolt.

FIG. 11 shows the face of the bolt carrier. This is the part of the bolt carrier that is in contact with the shell. There is shown here the ejector 114*a* and sub-ejector 114*b*. There is also shown a rod support 111 which is disposed above the ejector and sub-ejector. In this view 191 shows the face of the bolt with 103 being the firing pin.

In the use of this firearm a magazine which can be either of a linear type or of a drum type is attached to the trigger section below the receiver. At this point the first round is charged to the breech of the weapon by means of handle 32 which actuates rod 81, which in turn moves the bolt carrier and bolt mechanism rearwardly so that a shell can enter the breech of the firearm and then be moved forwardly into the firing chamber of the firearm. Once in this forward location, the bolt and bolt carrier are locked to the barrel extension by means of pin 108. It is not until the weapon is fired that the bolt will be released from the bolt carrier. This release of the bolt from the bolt carrier is caused by the gases from the barrel 29 passing upwardly through holes 51 into the gas tower 65. The gases contact surface 91 of the bolt carrier. Upon contacting this surface 91, the bolt carrier is forced rearwardly against spring 182 which then releases the bolt from the barrel extension. In the rearward travel of the bolt and bolt carrier, the hammer of the firearm is once again cocked as well as the spent shell being ejected and a new shell being loaded from the magazine into the breech of the weapon. On the forward travel of the bolt carrier and the bolt, the shell is moved into the firing chamber and is ready for firing. If the firearm is in the automatic mode, both the disconnector and the trigger sear are removed from the sequence by means of the selector 25. Therefore, as long as the trigger is depressed the auto sear and the auto kicker will be the only controlling means within the firing circuit. These will be automatically operated in firing the weapon continuously. However, as soon as the trigger is released the full trigger mechanism comes into operation and the firearm will cease automatic firing.

When the weapon is used in the semi-automatic mode, the operation of charging the first round into the breech of the firearm is the same as for when the weapon is being operated in an automatic mode. However, in this instance, the disconnector and the trigger sear remain in the firing sequence. In this mode it is the auto sear and the auto kicker that are not being utilized. Therefore when the bolt goes forward the auto kicker trips the auto sear and then the hammer is only being held by the disconnector and the trigger sear. A slight movement of the trigger will release the disconnector and upon a full pull on the trigger the trigger sear is released. In this instance then the hammer is released and a single round is fired. In this way the weapon can quickly be adjusted from automatic firing to semi-automatic firing. In each instance it is the rearward movement of the bolt carrier and bolt which recocks the hammer.

This firearm is relatively light and fairly easy to handle. It has a low felt recoil, but yet is effective to fire projectiles for more than 100 yards. Such projectiles from a shotgun shell will spread over a particular target area. Various modifications can be made to this firearm but yet be within the scope of the present invention.

The various important features with regard to the present firearm have been discussed above. These relate to the design of the bolt carrier and the bolt, the angle of the magazine when it delivers shells into the breech of the firearm, and the location and operation of the auto sear and of the auto kicker. As noted above, the arrangement of the bolt carrier and the bolt provides for the proper timing of the firearm and also provides for absorbing the torque created upon firing the firearm. Consequently, this bolt carrier and bolt provide for a unique and positive operation of the firearm.

I claim:

1. A firearm comprising:

a receiver portion having butt means for resting against the shoulder of a shooter;

a barrel extending forwardly from the receiver portion, said barrel having a charging end and a discharge end;

a gas tower in fluid communication with said barrel; a bolt carrier assembly slidably disposed in said gas tower whereby said bolt carrier assembly is actuated by gas pressure in said barrel from the discharge of a cartridge, the bolt carrier assembly further including a rearward end having a downwardly extending section having a first elongated slot with a longitudinal axis with respect to a longitudinal axis of the bolt carrier assembly, said downwardly extending section further including a second elongated slot having a longitudinal portion and downwardly directed cam portion disposed at the forward end, and a roller received in said second slot;

a bolt slidably connected to the bolt carrier assembly by a transverse bar fixed to the bolt and extending through the first elongated slot in the bolt carrier assembly whereby said bar and first elongated slot cooperate to limit axial movement of the bolt on the bolt carrier assembly, the bolt further having a recess in the upper surface thereof to receive the roller when said bolt carrier assembly is in a position rearward with respect to the bolt;

a firing pin disposed in said bolt;

a longitudinal track portion in said receiver and having an upwardly extending recess cooperating with said roller in the bolt carrier assembly;

wherein the roller is positioned in said recess in the track and in a rear portion of the second slot when the bolt carrier assembly is in a forward position with respect to the bolt and the receiver, and wherein rearward movement of the bolt carrier assembly with respect to the bolt causes the cam portion of the second elongated slot to engage the roller to move the roller into said recess in the bolt whereby said bolt carrier assembly and bolt move rearwardly with the roller engaging the track in the receiver and the recess in the bolt such that the bolt is in a fixed position with the bolt carrier assembly during rearward travel.

2. A firearm as in claim 1 wherein the downwardly extending section of said bolt carrier assembly has a cam at the forward end thereof to actuate a locking pin on said bolt.

3. A firearm as in claim 1 wherein the downwardly extending section of said bolt carrier assembly has a spring loaded kicker sear on the lower surface thereof to contact a cam on the lower surface of said bolt.

4. A firearm as in claim 1 trigger mechanism having selector means to enable either firing or continuous firing when the trigger mechanism is depressed.

5. A firearm as in claim 1 wherein said bolt includes an extractor and a sub extractor at one end to eject a shell and a guide means located above said extractor and said subextractor.

6. A firearm as in claim 1 including a drum magazine to charge a shell.

7. The firearm of claim 1 where said bolt includes a locking means to lock the bolt with respect to the barrel and a cam means on the bolt carrier assembly to actuate the locking means, said locking means being actuated by forward movement of the bolt carrier assembly with respect to the bolt.

8. The firearm of claim 1 wherein the bolt carrier assembly includes a piston received in said gas tower.

9. A firearm as in claim 1 including means to charge a shell comprising a magazine which is disposed forwardly at an angle of about 4 to 6 degrees.

10. A firearm as in claim 9 wherein said magazine is substantially linear.

11. A firearm as in 1 comprising a guide rod assembly passing through said bolt carrier assembly to guide axial movement of the bolt and bolt carrier assembly.

12. A firearm as in claim 11 wherein one end of said guide rod terminates in the butt means of the receiver.

13. A firearm as in claim 11 wherein said guide rod has a spring around at least a part of said guide rod to bias the bolt carrier assembly in a forward position.

14. A bolt and bolt carrier assembly for use a gas operated automatic firearm having a barrel and a gas tower communicating with the barrel, and a receiver portion in communication with the barrel and gas tower, said receiver having a longitudinal track having an upwardly disposed recess positioned rearward of the barrel, the assembly comprising;

a bolt carrier assembly slidably disposed in the gas tower and being actuated by gas pressure in the barrel and gas tower, said bolt carrier assembly being slidable from a forward position to a rearward position in the receiver, the bolt carrier assembly further including a downwardly extending section having a first elongated slot having a longitudinal axis with respect to a longitudinal axis of the bolt carrier assembly, the downwardly extending section further including a second elongated slot having a first portion having a longitudinal axis with respect to the longitudinal axis of the bolt carrier assembly and a downwardly directed cam portion disposed at the forward end, a roller member slidably received in said second slot, and means to actuate a locking means in a bolt;

a bolt slidably connected to the bolt carrier assembly by a transverse bar fixed to the bolt and extending through the first elongated slot, the bolt further including a complementary recess disposed in an upper surface thereof to receive said roller when said bolt carrier assembly is in a rearward position with respect to the bolt, said bolt further including locking means to lock the bolt with respect to the barrel and being actuated by forward movement of the bolt carrier assembly with respect to the bolt;

wherein the bolt is operatively connected to the bolt carrier assembly such that the bolt is in a fixed forward position with respect to the bolt carrier assembly when the bolt carrier assembly is in a rearward position with respect to the barrel and the bolt by the roller cooperating with the cam portion in the bolt carrier assembly, the recess in the bolt and the track in the receiver, and wherein the cam portion of the bolt carrier assembly urges the roller upwardly into the recess in the track when the bolt engages a rearward end of the barrel and the locking means the bolt in position with respect to the barrel by forward movement of the bolt carrier assembly with respect to the bolt.

15. A bolt and bolt carrier assembly as in claim 14 comprising a firing pin which extends through said bolt carrier assembly to a forward face of said bolt.

16. A bolt and bolt carrier assembly as in claim 14 wherein on said forward face of said bolt there is an extractor and a sub-extractor for ejecting shells and a guide means disposed between the extractor and sub-extractor.

17. A bolt and bolt carrier assembly as in claim 14 wherein said bolt carrier assembly has a spring tensioned kicker sear which is engaged by a cam on said bolt.

* * * * *